US007138947B2

(12) United States Patent
Fisher et al.

(10) Patent No.: US 7,138,947 B2
(45) Date of Patent: Nov. 21, 2006

(54) ANTENNA

(75) Inventors: James Joseph Fisher, Badger Farm (GB); Roderick Leonard Wallace Stevens, Hants (GB)

(73) Assignee: Roke Manor Research Limited, Romsey (GB)

( * ) Notice: Subject to any disclaimer, the term of this patent is extended or adjusted under 35 U.S.C. 154(b) by 230 days.

(21) Appl. No.: 10/606,113

(22) Filed: Jun. 26, 2003

(65) Prior Publication Data

US 2004/0113856 A1 Jun. 17, 2004

(30) Foreign Application Priority Data

Jul. 20, 2002 (GB) ..... 0216938.1

(51) Int. Cl.
*H01Q 1/38* (2006.01)

(52) U.S. Cl. ..... 343/700 MS

(58) Field of Classification Search ..... 343/767, 343/778, 815, 817, 845, 700 MS
See application file for complete search history.

(56) References Cited

U.S. PATENT DOCUMENTS 4,978,965 A 12/1990 Mohuchy
5,268,701 A 12/1993 Smith
5,896,107 A * 4/1999 Huynh ..... 343/700 MS
6,028,562 A 2/2000 Guler et al.
6,195,063 B1 * 2/2001 Gabriel et al. ..... 343/797
6,246,377 B1 * 6/2001 Aiello et al. ..... 343/770
6,292,153 B1 * 9/2001 Aiello et al. ..... 343/767
6,531,984 B1 * 3/2003 Johannisson et al. 343/700 MS

FOREIGN PATENT DOCUMENTS

DE 32 15 323 A1 4/1982
EP 0 349 069 * 6/1989

* cited by examiner

*Primary Examiner*—Shih-Chao Chen
*Assistant Examiner*—Minh Dieu A
(74) *Attorney, Agent, or Firm*—Crowell & Moring LLP

(57) ABSTRACT

A dual polarised antenna 1 has two types of antenna elements combined. Each type of antenna element is formed on a planar substrate. The substrates are furnished with inter-engaging slots to enable assembly of the elements. Signal feeds are connected to the active parts of the elements by means of connection points furnished at off axis positions. The off-axis positions for connection enable an arrangement in which the locus of the effective phase centres of the antenna element scan be co-located yielding a convenient arrangement with good performance.

13 Claims, 4 Drawing Sheets

ANTENNA

FIELD OF THE INVENTION

This invention relates to an antenna including Vivaldi antenna elements.

BRIEF DESCRIPTION OF THE BACKGROUND TO THE INVENTION

A Vivaldi antenna element is a radiating element having a tapering slot or notch formed by the element which produces a linear polarisation to the radiated signal. An example of a Vivaldi antenna is described in patent application GB1601441.

Vivaldi type elements have been incorporated into larger arrays to form phased array antennas as described in EP0349069. The antenna produces radiated signals having planes of polarisation which are orthogonal and it is used in radar and other direction finding applications. The array is formed by horizontal and vertically disposed planar substrates bearing the metallised layers etched to produce the antenna elements. The substrates are configured to interlock by means of inter-engaging projections and rebates and the array is formed into a number of square sectioned open ended boxes with the sides of the boxes each bearing a tapering Vivaldi notch. The problem of coupling signals into and out of the notch when the two orthogonal notches have phase centres which are co-located is addressed in an imperfect manner in the prior art described in that document. Indeed the problem is described as insurmountable and another approach is adopted namely ensuring that phase centres of the elements are not co-located. However, by not co-locating the phase centres it is necessary for signal processing to be employed that compensates for the arrival of an incoming signal at phase centres at different times and this is undesirable.

SUMMARY OF THE INVENTION

It is amongst the objects of the invention to mitigate or at least alleviate the drawbacks of the prior art arrangements and according to the invention there is provided a dual polarised antenna comprising at least first and second substantially planar Vivaldi antenna elements having active portions for receiving or radiating signals from a direction forward of the antenna, the antenna elements having mutually intersecting planes and having phase centres of the active portions substantially co-located, and respective antenna element feeds coupled to respective antenna elements at a position to the rear of the active portions and displaced from an axis extending through the phase centres and the intersection of the planes of the antennas.

By locating the antenna element feeds at a position displaced from the axis it is possible to arrange the antenna elements with their phase centres co-located.

Preferably the antenna elements are formed as metallised layers. Preferably, the antenna feed is connected to a land formed by the metallised layer. The metallised layer will extend inwards from the land towards the axis passing through the phase centre to a flare portion of the Vivaldi antenna.

BRIEF DESCRIPTION OF THE DRAWINGS

A specific embodiment of the invention will now be described, by way of example only, with reference to the drawings in which.

DETAILED DESCRIPTION OF A PREFERRED EMBODIMENT

Figure 1:
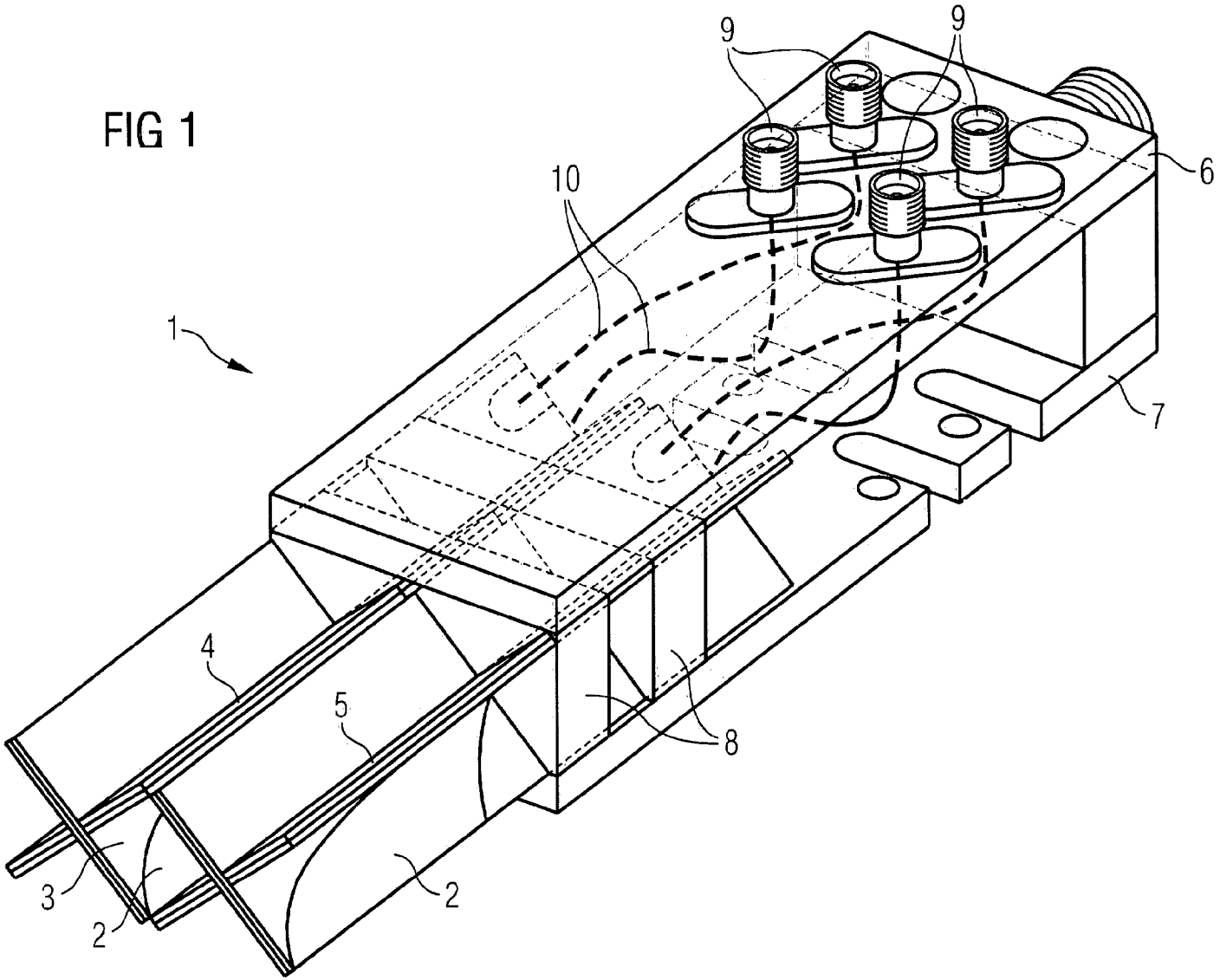
FIG. 1 shows antenna in accordance with the invention.

As is shown in FIG. 1, an antenna in accordance with the invention 1 comprises a number of antenna elements four of which are shown although in practice there could be many more. There are two types of elements, "A" elements 2,3 and "B" elements 4,5. (There is no significance to the choice of labels "A", "B".) These are physically interlocked by mutually engaging slots to form longitudinal antenna sub-units having a cruciform cross-section. The elements will be described in greater detail later.

The antenna sub-units are held between two Perspex mounting plates 6 and 7 in conjunction with a number of Perspex corner spacers 8. The upper mounting plate 6 is provided with four co-axial cable connectors 9. The connectors 9 are coupled to the antenna elements 2 to 5 by means of four phase-matched semi-rigid cables 10. By phase-matched it means that the cables are of the same length to ensure that input signals reach the antenna elements at the same time. In use, the connectors are connected by co-axial cable to a transmitter or receiver circuit of in this case a communications system.

All the elements, whether of type A or B, have planar metallised layers on a planar substrate. An element is shown in isolation in FIG. 2. It comprises three metallised and etched layers 21, 22 and 23 on a substrate of Rogers RT Duroid 6010 microwave substrate material 24. The thickness of the layers are exaggerated in the figure for clarity. The two outer layer patterns are identical whilst the inner metal layer 22 departs from the shape of the outer layers as shown in broken outline. The inner layer is a reflection of the other layers in the axis 25 along the region 26. A slot 27 is provided on the axis which as will be described later engages a slot formed in the other type of element.

Figure 2:
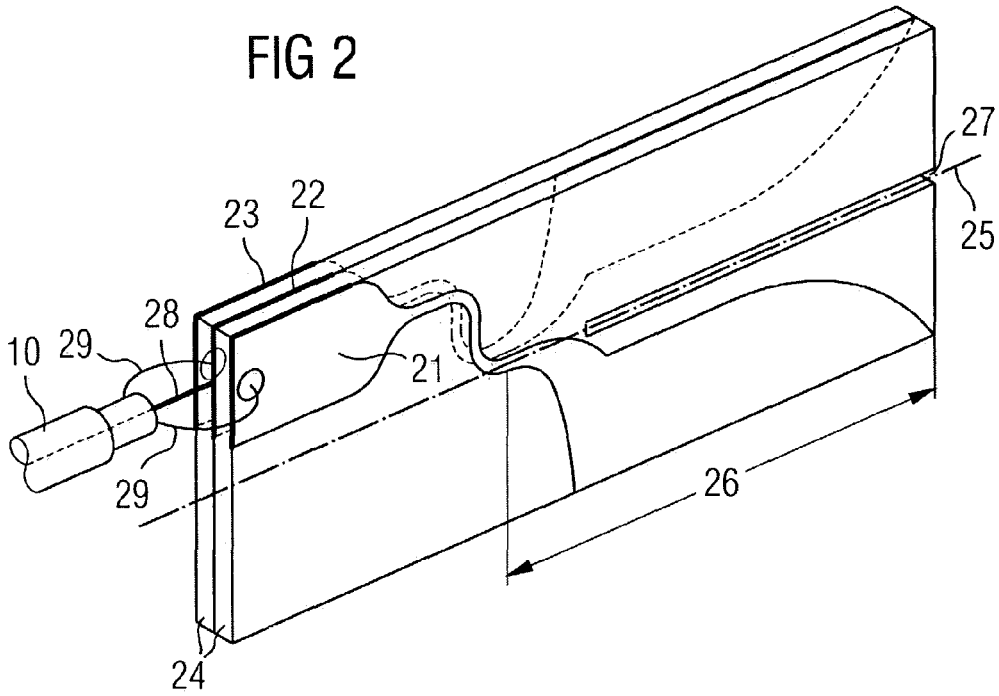
FIG. 2 shows an antenna element used in the antenna of FIG. 1.

FIG. 2 also shows the manner in which the cables 10 are connected to the layers of the elements. It can be seen that an inner core 28 of the cable 10 is connected to the inner metallised layer 22 whilst the outer braid 29 is connected to both outer layers 21 and 23. The connections are made by soldering.

Figure 3A:
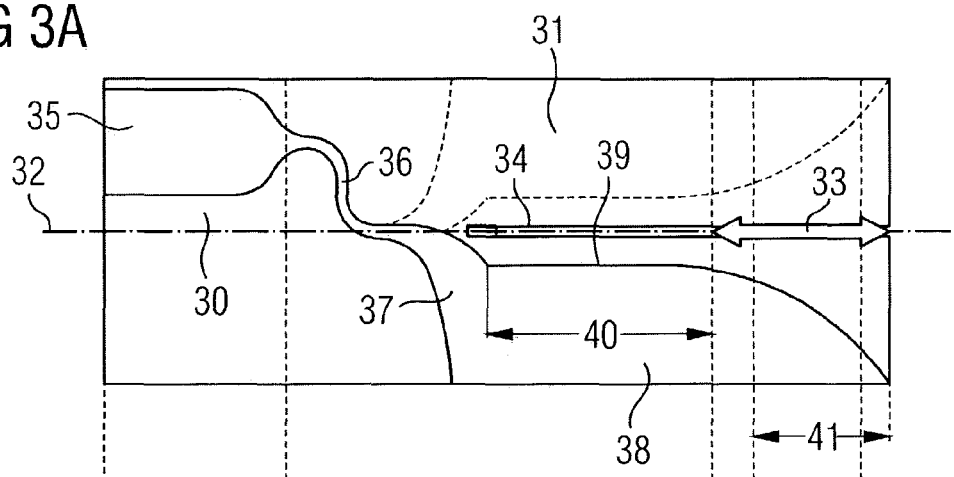
FIG. 3 shows plan views of A and B type antenna elements used in the antenna of FIG. 1.
Figure 3B:
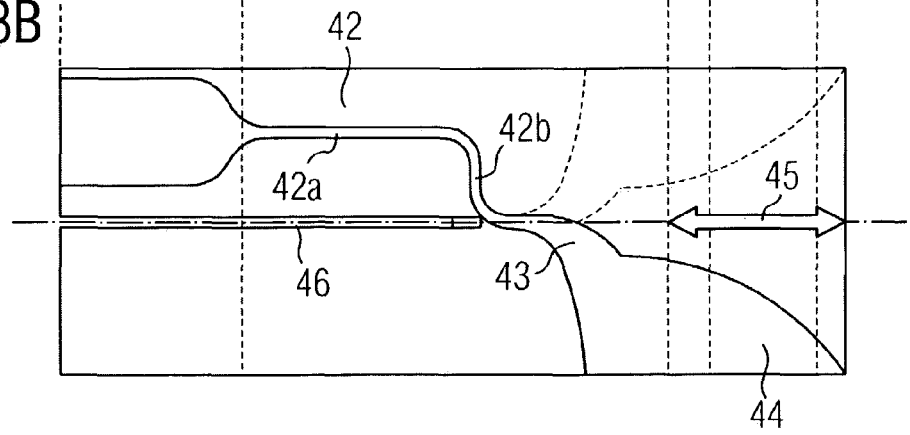

Having described the elements in a generic way a more detailed explanation of the elements will be given with reference to the plan views of FIGS. 3*a* and 3*b*. FIG. 3*a* shows the A type element. It comprises the three metallised layers etched to form the Vivaldi antenna on a substrate of Rogers RT Duroid 6010 material. In the figure the outermost metal layer 30 is shown in the darker shading. The other outermost layer on the lowest surface is not visible in the figure but it matches the shape of layer 30. The lighter shading shows the inner metal layer 31 which is hidden by the substrate.

The A element has a longitudinal phase centre axis 32 which passes through the locus of effective phase centre shown by arrow 33. The position of this will depend on the frequency in use. A slot 34 is provided along part of the length of the axis. This slot inter-engages with another formed on the other element during assembly.

The metallised layer 30 is configured into a number of distinct portions. Progressing from left to right in the figure the first portion is a stripline section 35. The stripline section 35 is formed as a generally rectangular pad to which the cable 10 is soldered. The inner side face of the rectangle curves outwards in the plane of the element and narrows to form a twinline section 36. The twinline section 36 curves gently downwards towards the axis 32 and then curves back to the horizontal before the section broadens asymmetrically away from the axis to the edge of the element to form a feed flare 37. The outer edge 38 of the metallised layer remains over the rest of its axial length at the edge of the element. The inner edge 39 transitions from a downward curve of the feed flare to extend in an axial direction parallel to but spaced downwardly apart from the axis 32. This forms a constant slot section 40. At the end of the constant slot section 40 the inner edge curves smoothly away from the axis to a corner of the element to form an end flare 41. Overall the metallised layer 30 transitions from the stripline section 35 to the end flare 41 across the axis 32.

The other outer metallised layer (not shown) matches the described layer 30. The inner layer 31 matches the configuration of the stripline section 35 and most of the twinline section 36. However, in the transition from the twinline section to the feed flare the layer curves upwardly away from the axis as depicted in the figure. In a sense, the shape of the layer 31 over the feed, flare, constant slot section and the end flare is a mirror of the outer layer 30 with the notional mirror being at the axis 32. The performance of the layers is such as to give a locus of effective phase centre at the position indicated by arrow 33. The locus centre varies over the range of the arrow depending upon the frequency.

The other element type is shown in FIG. 3*a*. The metallised layers are of a similar configuration as earlier described. The main difference is that the twinline section 42 extends in an axial direction to form a part which is parallel 42*a* to the axis before it transitions to a downwardly curving portion 42*b* to meet the axis 32. It will be also noticed that the constant slot section of the first element type is not present in this type of element with the feed flare 43 transitioning directly into the end flare 44. The layers have a performance which gives a locus of effective phase centre over a range represented by arrow 45 which extends along the axis. An axial slot 45 is provided to enable assembly to the other type of element to be described later.

The FIGS. 3*a* and 3 are aligned to permit comparison of the features. It will be seen that A type of element has its locus of effective phase centre 33 over the same range of positions as the locus 45 of the type B element. The end flares of both types, are of the same rate of curvature.

Figure 4:
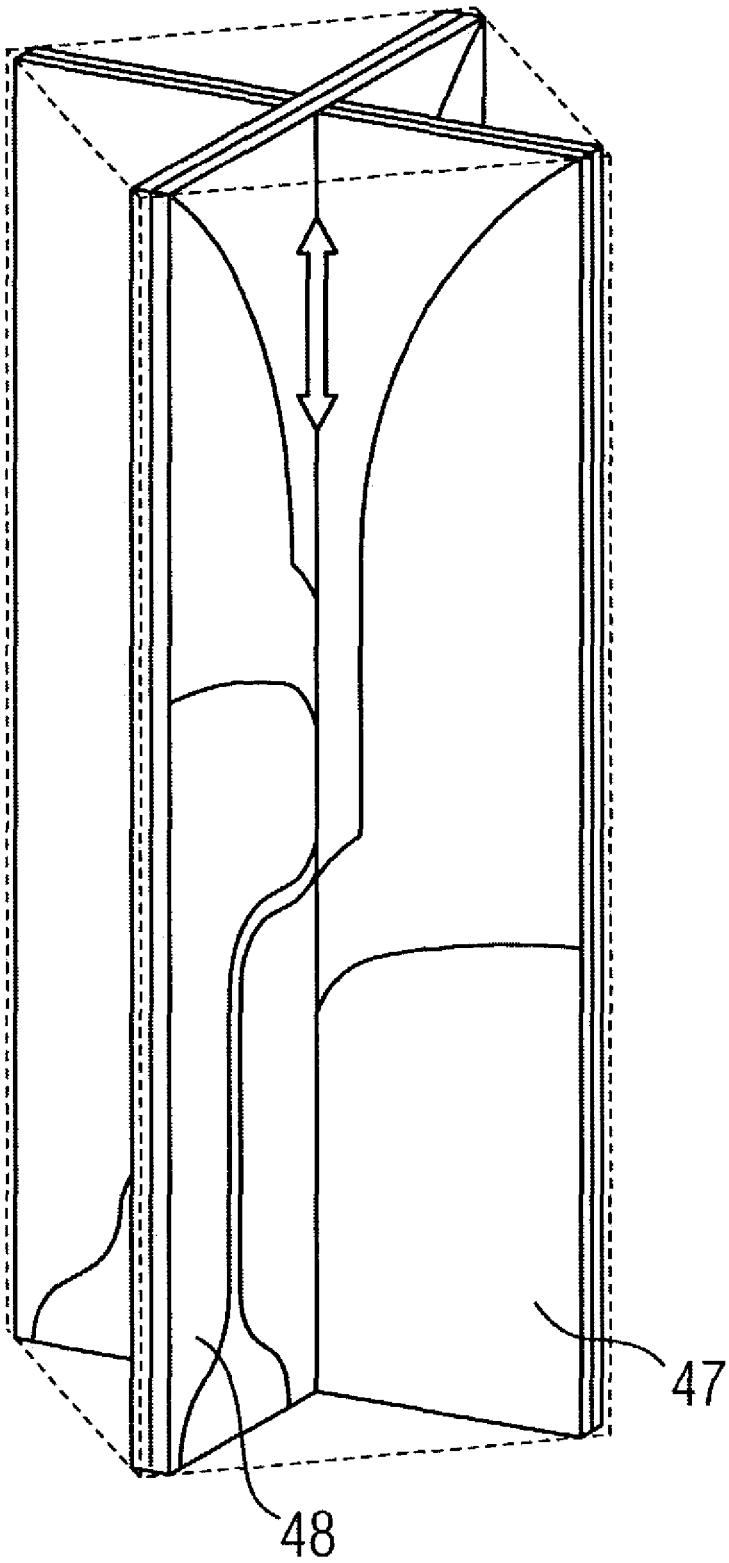
FIG. 4 shows an antenna element subassembly.

The elements are assembled by aligning the slots 45 and 33 and pushing the two elements axially together to engage the walls of each slot with the faces of the other element. This means of assembly is possible because of the off-axis connection facilitated by the stripline section 35. If the stripline were located on the axis the connections could not be made in the optimal manner. FIG. 4 shows an assembled module of an A type element 47 and a B type element 48.

Figure 5A:
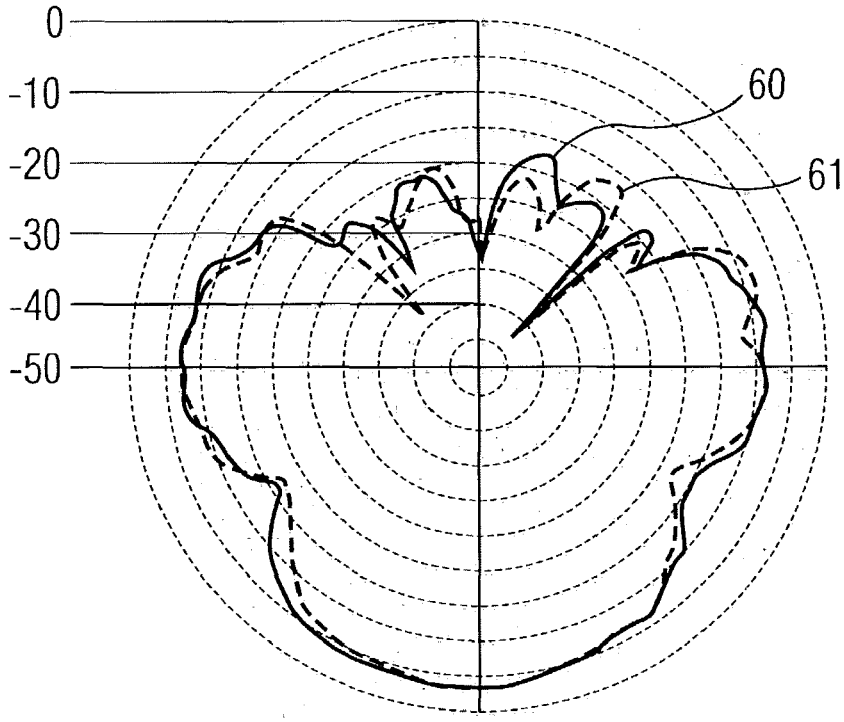
FIG. 5 shows antenna patterns of the antenna shown in FIG. 1.

FIG. 5 shows the measured beam pattern for the antenna. The top figure, FIG. 5*a*, shows the pattern of the A type element on its own and when used at the same time as the type B element is in use. The alone beam pattern 60 and the together beam pattern 61 are closely matched illustrating the antennas good performance.

Figure 5B:
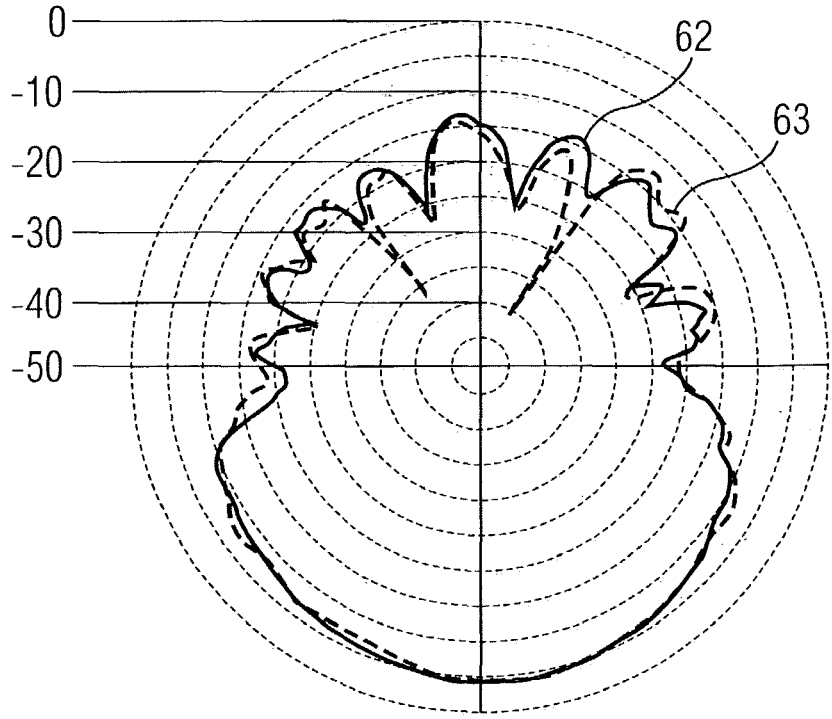

FIG. 5*b* shows the pattern for the B type element alone, line 62, and when used at the same time as the A type element, line 63. Again, the lines are closely matched illustrating the antennas good performance.

As will be appreciated a large number of variations in the antenna shape can be envisaged and many more elements of the same or different types can be combined into larger antenna arrays without departing from the spirit and scope of the appended claims.

We claim:

1. A dual polarized antenna comprising:

at least first and second substantially planar Vivaldi antenna elements; and antenna element feeds; wherein, the antenna elements have active portions for receiving or radiating signals from a direction forward of the antenna;

the antenna elements have mutually intersecting planes;

a phase center of the active portions of the antenna elements are substantially collocated;

the antenna element feeds are coupled to the respective antenna elements, and extend to the respective antenna elements from a position that is i) rearward of the active portions, and ii) displaced from an axis extending through the phase centers and the intersection of the planes of the antennas; and each antenna element has a feed flare and an end flare, with a substantially constant slot section disposed therebetween.

2. An antenna as claimed in claim 1, further comprising an antenna feedline connected to the antenna element feeds at the position displaced from the axis.

3. An antenna as claimed in claim 2 wherein the antenna feedline crosses the axis.

4. An antenna as claimed in claim 3 wherein the antenna feedline comprises a stripline section and a twinline section.

5. An antenna as claimed in claim 1 wherein the feedline includes a parallel section substantially parallel to the axis.

6. An antenna as claimed in claim 5 wherein the parallel section of the first element has substantially the same length as the constant slot section of the other element.

7. An antenna as claimed in claim 1 wherein the locus of effective phase centers of the elements are co-located.

8. An antenna as claimed in claim 1 wherein the antenna elements are joined by mutually engaging formations.

9. An antenna as claimed in claim 8 wherein the mutually engaging formations include slots made in the elements.

10. An antenna as claimed in claim 9 wherein the elements are formed by substrates and metallized layers.

11. An antenna as claimed in claim 1 wherein the first and the second elements have substantially matching end flares.

12. Radiowave receiving apparatus having an antenna, comprising:

at least first and second substantially planar Vivaldi antenna elements; and antenna element feeds, wherein, the antenna elements have active portions for receiving or radiating signals from a direction forward of the antenna;

the antenna elements have mutually intersecting planes;

phase centers of the active portions of the antenna elements are substantially collocated;

the antenna element feeds are coupled to the respective antenna elements, and extend to the respective antenna elements from a position that is i) rearward of the active portions, and ii) displaced from an axis extending through the phase centers and the intersection of the planes of the antennas; and each antenna element has a feed flare and an end flare, with a substantially constant slot section disposed therebetween.

13. Radiowave transmitting apparatus having an antenna, comprising:

at least first and second substantially planar Vivaldi antenna elements; and antenna element feeds; wherein, the antenna elements have active portions for receiving or radiating signals from a direction forward of the antennas;

the antenna elements have mutually intersecting planes;

phase centers of the active portions of the antenna elements are substantially collocated;

the antenna element feeds are coupled to the respective antenna elements, and extend to the respective antenna elements from a position that is i) rearward of the active portions, and ii) displaced from an axis extending through the phase centers and the intersection of the planes of the antennas; and each antenna element has a feed flare and an end flare, with a substantially constant slot section disposed therebetween.

* * * * *